US007074361B2

(12) United States Patent
Carolla et al.

(10) Patent No.: US 7,074,361 B2
(45) Date of Patent: Jul. 11, 2006

(54) LADLE

(75) Inventors: Lou Carolla, Olmsted Falls, OH (US); James Barry Cole, Cleveland, OH (US); Steven Robert Lillie, Conneaut, OH (US)

(73) Assignee: FOSECO International Limited, Staffordshire (GB)

( * ) Notice: Subject to any disclaimer, the term of this patent is extended or adjusted under 35 U.S.C. 154(b) by 0 days.

(21) Appl. No.: 10/803,891

(22) Filed: Mar. 19, 2004

(65) Prior Publication Data

US 2005/0206052 A1 Sep. 22, 2005

(51) Int. Cl.

| | |
|---|---|
| ***C21C 5/42*** | (2006.01) |
| ***C21B 3/00*** | (2006.01) |
| *C21C 5/44* | (2006.01) |

(52) U.S. Cl. ..... 266/236; 266/275; 222/605

(58) Field of Classification Search ..... 266/236, 266/275; 222/605
See application file for complete search history.

(56) References Cited

U.S. PATENT DOCUMENTS

| | | | | |
|---|---|---|---|---|
| 1,344,688 | A * | 6/1920 | Griner | 222/605 |
| 4,330,107 | A * | 5/1982 | Lynham | 222/605 |
| 4,391,636 | A * | 7/1983 | Windish | 266/275 |

FOREIGN PATENT DOCUMENTS

| | | | | |
|---|---|---|---|---|
| EP | 0071363 | * | 2/1983 | 222/605 |

* cited by examiner

*Primary Examiner*—Scott Kastler
(74) *Attorney, Agent, or Firm*—Nixon & Vanderhye

(57) ABSTRACT

A liner for a ladle is formed of a body of refractory material defining a hollow interior which is bounded by a continuous sidewall. Within the interior is a barrier of refractory material which faces the interior surface of part of the sidewall and is spaced inwardly therefrom in the hollow interior of the body to define with said facing part of said sidewall a spout for discharging molten metal, in use, from the ladle. The barrier has two longitudinal edge surfaces received at two facing inner portions of the sidewall respectively which are extended inwardly. By providing these inward extensions the barrier can be positioned within the interior of the liner thereby obviating the need for an outward extension from the liner body to define a spout. This enables the liner to be used with ladle shells without the shell requiring modification to accommodate such an outward extension.

16 Claims, 2 Drawing Sheets

FIG 1
PRIOR ART
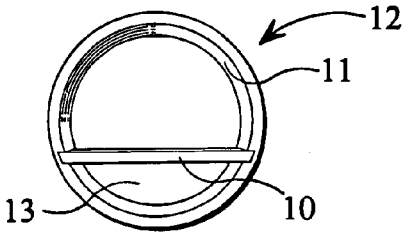
FIG 2
PRIOR ART
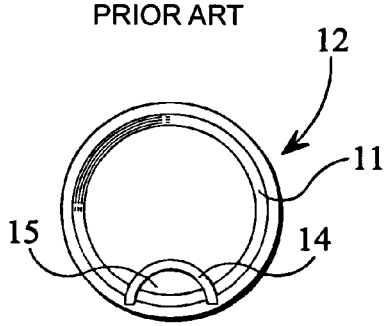
FIG 3
PRIOR ART
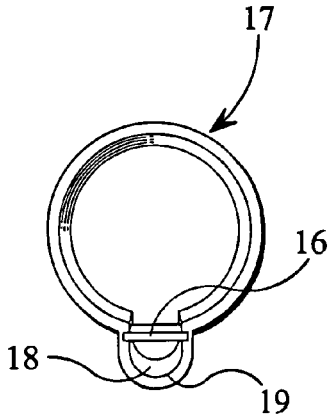
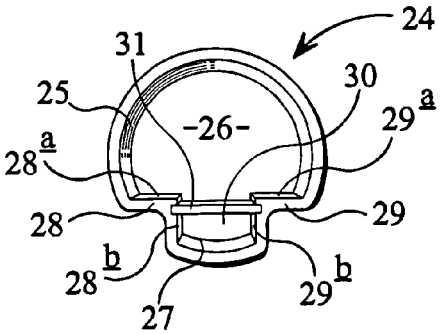
FIG 4

LADLE

BACKGROUND OF THE INVENTION

This invention relates to ladles for molten metal, and particularly to liners for such ladles.

Ladles for molten metal are generally in the form of a truncated cone made of iron or steel having internal linings of refractory material. Initially the liner materials, namely silica, aluminum and magnesite based materials, were mixed with an inorganic binder to form a refractory layer which could withstand the high pouring temperatures and corrosive slags of ferrous metals. The materials were either hand rammed into place or poured/packed around a form to produce the inside shape of the ladle.

One form of ladle for molten metal, known as a teapot ladle, is distinguished by a spout, extending from the bottom of the ladle to its top edge, or lip, thus ensuring the provision of clean metal to the mold from the interior of the ladle.

Using traditional refractory practices, foundries can produce the spout of the teapot design in many ways. For example a half round or flat refractory tile can be embedded into the internal cylindrical sidewall of the refractory liner. However, all conventional refractory materials used must be preheated, at considerable cost, to avoid chilling the metal and to prevent thermal shock to the refractory.

In the early 1980's KALTEK (RTM) shank ladle liners were introduced. These are one-piece linings made of silica, aluminum and magnesite, and are vacuum formed and bonded with an organic material such as phenolic resin to make the product strong (for transportation purposes) when cured. These liners are low density and low thermal conductivity and are thus insulating by nature, compared to conventional refractory liners. They do not last as long as conventional refractory liners, and thus the material costs are greater. However, being easy to install without the need for special equipment, insulating by nature, frequently changed out and not requiring preheat, there are many advantages, such as lower labour and energy costs, lower employee injury, better metal temperature control, lower scrap rates and no pre-heat costs.

In use, a layer of coarse sand is poured into the bottom of an empty ladle shell and the KALTEK (RTM) liner is placed inside the shell on the bed of sand and levelled With the top of the ladle shell. More sand is poured between the liner and shell until a level slightly below the top of the liner is achieved. A capping material is then applied to the void below the top of the liner to prevent the sand from coming out of the ladle during the pouring when the ladle is tipped forward. The capping material can be any self drying material such as aqueous sodium silicate mixed with sand. The capping material is vented allowing gas from the organic binder to escape when metal is poured into the ladle.

Upon the introduction of KALTEK (RTM) liners, consideration was given to the development for a teapot ladle of a KALTEK (RTM) liner of cylindrical or truncated cone shape having a pouring spout to serve as part of a teapot ladle system.

Initially it was proposed to use a straight/flat tile (dam or barrier plate) embedded into the liner internal sidewall to form the spout. Such a proposal is shown in FIG. 1, with the tile 10 being embedded, with refractory mortar, into grooves in the inner sidewall 11 of the liner 12, so as to define a spout 13, through which poured metal flows, in use. A similar liner for a teapot ladle is shown in FIGS. 2 and 3 of U.S. Pat. No. 4,330,107, where again the flat tile is embedded in the sidewall of a KALTEK (RTM) liner.

With the flat tile itself being of KALTEK (RTM) material, it was found that it did not last as long as required to justify its high cost before it broke.

Moreover, the KALTEK (RTM) material was found to gas into the metal contained in the liner because its organic components burn out on contact with the high metal temperatures. In the walls (i.e. the body) of the ladle lining, the resultant gases exit through the backing sand, causing no problems. Unfortunately the dam or barrier plate is surrounded on both sides with molten metal, causing excess hydrogen and nitrogen pickup in the metal itself. This creates defects in the final castings.

Making the flat tile of conventional refractory/ceramic material was never implemented as, although a longer life could be expected, it would be of very high cost and would be expected to cause a chill effect on the metal mentioned above.

An alternative solution attempted was to use a half-round tile (dam or barrier plate) embedded into the liner internal sidewall to form the spout. Such a proposal is shown in FIG. 2, with the tile 14 being embedded, with refractory mortar, into grooves in the inner sidewall 11 of the liner 12 to define a spout 15, through which metal flows, in use.

With the half-round tile being of conventional refractory/ceramic material, it was found that it cracked due to 'thermal stress' related to its curved shape. Additionally it sometimes came loose from the grooves. Its cost was however lower than a flat tile, because its shape allows it to be smaller. It was never contemplated making the half-round tile of KALTEK (RTM) material, as this would have been expensive due to the need for complex tooling. The KALTEK (RTM) material would still gas into the metal excessively and such a tile would not have been expected to have a life any longer than a flat tile, perhaps shorter.

To overcome this problem of producing a KALTEK (RTM) liner for a teapot ladle, a solution was developed in 1987 which involved using a smaller (less wide), flat, cast refractory or ceramic tile (dam or barrier plate) 16, thus decreasing the cost, fitted at the periphery of the circular section liner 17, as shown in FIG. 3. In order not to close off the bottom opening of the spout 18 partly defined by the tile faster than the top, resulting in an inability to achieve cost, flow rate and thermal performance objectives, the circular section liner had to be provided with an externally curved, outward hollow extension 19 extending downwardly the whole length of the liner below the upper lip.

Insulating tiles, e.g. of KALTEK (RTM) material, were not used in this new design, because they did not possess the longevity required, and because the organically bonded KALTEK (RTM) material would gas excessively.

Although this new design works well, with the tile being of lower cost due to its smaller size, it suffers from the disadvantage that most foundry ladles in which the liner would be set had to be modified to include room for the extension 19. Most such ladles are of cylindrical cross-section with various lip designs to fit their specific application or moulding line layout. Modifying and rebalancing the ladle costs time and money and often results in delays of product trials.

SUMMARY OF THE INVENTION

It has thus been appreciated that what is required is a teapot liner which would fit into any foundry ladle shell without the need to modify it, and an object of the invention is to provide such a liner, as well as a ladle provided with such a liner.

According to a first aspect of the invention, there is provided a liner for a ladle, the liner comprising a body of refractory material defining a hollow interior, the body having a continuous sidewall bounding said hollow interior, a lower closure floor and an open top, a barrier of refractory material facing an interior surface of part of the sidewall and being spaced inwardly therefrom in said hollow interior, the barrier extending from at or near the open top of the body towards said lower closure floor to define, with said facing part of said sidewall, a spout for discharging molten metal, in use, from said interior of the ladle, the barrier having two longitudinal edge surfaces, two facing inner portions of the sidewall being extended inwardly, said longitudinal edge surfaces of the barrier being received at said inwardly extended portions respectively, thereby positioning said barrier at said inward spacing from, and facing, said interior surface of part of the sidewall.

As there is no outward extension from the body, as in FIG. 3, to form the spout, a liner of the first aspect of the invention can fit into existing ladles without modification, i.e. the ladles can remain of cylindrical or of truncated cone shape and do not need to be modified to accommodate any outward extension of the liner. However, such a liner can be customized to fit any lip design that the foundry has or prefers. A low cost solution is thus provided, by the elimination of the body extension and the use of a smaller tile.

Although the barrier would preferably be flat/straight, it could be of curved shape.

In one embodiment the longitudinal edge surfaces of the barrier are received in respective complementary grooves in said inwardly extended portions respectively, whilst in another embodiment respective projections of said inwardly extended portions are received in complementary grooves in said longitudinal edge surfaces respectively.

Desirably said inwardly extended portions of the sidewall-provide respective flat facing surfaces, which are a preferably parallel, and at which, more desirably, said longitudinal edge surfaces of the barrier are respectively received, with said barrier, if flat, being disposed normal to said flat facing surfaces.

Refractory cement or other suitable fixing means is used to fix the barrier in place at said inwardly extended portions. Alternatively the barrier can be secured in place as part of the manufacture of the body of the liner.

The barrier desirably terminates spaced from the lower closure floor of said body, but in another embodiment it can extend to said floor, with there being an aperture therein adjacent its lower end to allow molten metal to pass, in use, into said spout. Conveniently the barrier extends from the level of the open top of said body.

Advantageously the barrier is in the form of a refractory tile. In one embodiment the tile is of castable material.

Conveniently the liner is of KALTEK (RTM) material, and desirably the barrier is of refractory/ceramic material, i.e. highly refractory and not organically bonded material.

According to a second aspect of the invention there is provided a ladle comprising an outer metal shell defining a hollow interior, the shell having a continuous inner sidewall, bounding said interior of the shell, a lower closure floor and an open top, and the ladle also comprising a liner, retained in said interior of the shell, in use, the liner comprising a body of refractory material defining a hollow interior, the body having a continuous sidewall bounding said hollow interior, a lower closure floor and an open top, a barrier of refractory material facing an interior surface of part of the sidewall of the body and being spaced inwardly therefrom in said hollow interior of the liner, the barrier extending from at or near the open top of the body towards said lower closure floor of the liner to define, with said facing part of said inner sidewall of the liner, a spout for supplying molten metal, in use, from said interior of the liner, the barrier having two longitudinal edge surfaces, two facing portions of the inner sidewall of the liner being extended inwardly, said longitudinal edge surfaces of the barrier being received at said inwardly extended portions respectively, thereby positioning said barrier at said inward spacing from and facing, said interior surface of part of the sidewall.

As there is no outward extension from the body of the liner below the pouring lip thereof, the ladle shell similarly does not need to be extended outwardly to accommodate such a liner extension. Thus existing ladle shells can be lined with a liner of the invention without the need for modification.

BRIEF DESCRIPTION OF THE DRAWINGS

The invention will now be described, by way of example, with reference to the accompanying drawings, in which:

FIG. 1 is a plan view of a prior art liner for a ladle,

FIG. 2 is a similar view to that of FIG. 1 of another prior art liner for a ladle, FIG. 3 is a similar view to that of FIG. 1 of a still another prior art liner for a ladle, FIG. 4 is a similar view to that of FIG. 1 of a ladle liner of the invention.

DETAILED DESCRIPTION OF PREFERRED EMBODIMENTS

Figure 5:
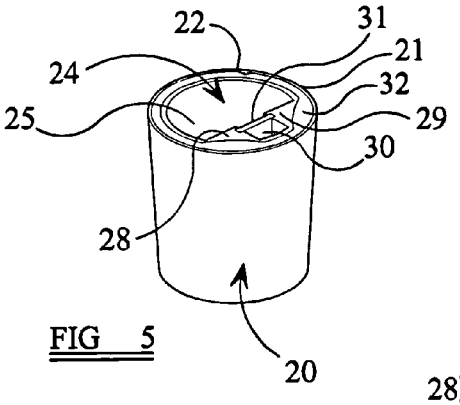
FIG. 5 is a top perspective view of a ladle of the invention.
Figure 6:
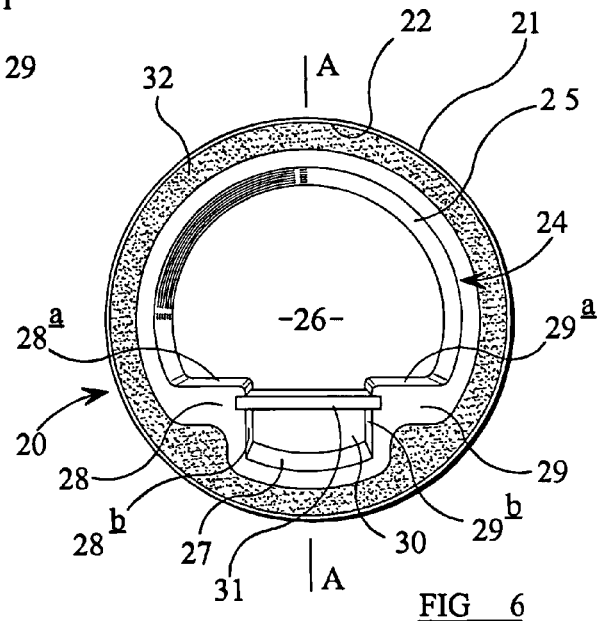
FIG. 6 is an enlarged top plan view of the ladle of FIG. 5.
Figure 7:
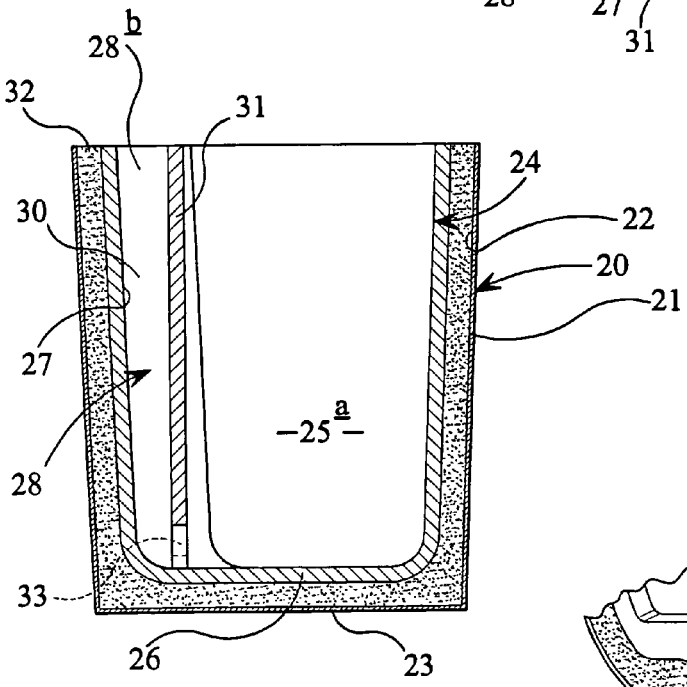
FIG. 7 is a sectional side view of the ladle of FIG. 5.

A ladle of one embodiment of a second aspect of the invention is shown in FIGS. 5 to 7, with a liner thereof being shown separately in FIG. 4. The ladle is in the form of a teapot ladle having a conventional metallic ladle shell 20 of cylindrical shape. The shell 20 is slightly tapered, as shown best in FIG. 7, with a constant wall thickness, but alternatively it could be wholly cylindrical, i.e. non-tapered, and as a further alternative it could be of non-circular section in plan, i.e. n-sided, where n>3, particularly square. The shell thus has a hollow interior bounded by a continuous sidewall 21 having an inner surface 22. It is closed at one end, its lower end in use, by a flat lower floor 23 but is open at its other, top end. Fitted within the interior of the ladle shell with a clearance therearound is a one-piece liner 24. The liner comprises a body 25 of refractory material, preferably KALTEK (RTM) material, the body being of circular section in plan but being of slightly truncated cone form, i.e. tapering slightly inwardly from top to bottom as shown in FIG. 7, and thus being shaped externally to match or substantially to match the interior shape of the ladle shell sidewall. The body has a hollow interior which is bounded by a continuous sidewall having an inner surface 25*a*. The liner has its top open, but its bottom or lower end is closed by a flat base or floor 26.

Within the interior of the body 25 at respective opposite sides of a generally vertical internal surface 27 of part of the liner sidewall, are formed respective inwardly extended portions 28, 29. As shown best in FIG. 6, the inwardly thickened portions which extend inwardly from the arcuate inner surface 25*a* of the body 25, form respective right-angled corners having first surfaces 28*a*, 29*a* respectively at 90° to the diameter A of the body extending through the center of the surface 27, and respective second surfaces 28*b*, 29*b* at right angles to the first surfaces, i.e. parallel to the diameter A and effectively extending from the first surfaces to the surface 27. Preferably the inwardly extended portions are from the open top of the body 25 to the floor 26 thereof. The size of the inwardly extending portions 28, 29 can be varied as required, i.e. the spacing between the surfaces 28*b*, 29*b* can be larger or smaller than that shown in FIGS. 4 to 7, and similarly the spacing of the surfaces 28*a*, 29*a* from the surface 27 could also be greater or smaller than that shown. The purpose of the inwardly extended portions is to provide means for mounting a barrier of refractory material which faces the surface 27, but is spaced inwardly therefrom in the interior of the liner, so as to define, with surface 27 and surfaces 28*b*, 29*b*, a spout 30 for discharging molten metal, in use, from the interior of the ladle when it is tipped.

The surfaces 28*b*, 29*b* could be other than parallel to diameter A, e.g. each such surface could be at an angle thereto, and moreover each such surface need not be flat.

In the embodiment shown, the barrier is in the form of a flat rectangular tile 31 cast from refractory or ceramic material. Preferably the tile would not be of KALTEK (RTM) material from which the remainder of the liner is made, but would be of refractory/ceramic material, i.e. highly refractory and not organically bonded. As shown in the drawings, the surfaces 28*b*, 29*b* are provided with respective facing vertical grooves of any convenient shape, with the tile 31 having a width such that its opposite longitudinal edges/edge surfaces can be received in said grooves to dispose the tile vertically in the liner, as shown best in FIG. 7, the tile being spaced inwardly and rearwardly of the surface 27, to form the spout 30 referred to above, this again being best shown in FIG. 7. The tile can be firmly secured in position in the grooves of the portions 28, 29 respectively by refractory cement or any other suitable fixing composition.

Alternatively the body of the liner could be formed around the tile during manufacture. The KALTEK (RTM) liner can be produced by vacuum forming an aqueous slurry of refractory and binder around a former/mandrel, stripping this 'green' and then oven drying to cure/harden. The tile can therefore be put in place first and the liner body formed around it to secure it in place. The final product is then stripped and oven dried.

With the liner positioned correctly in the interior of the ladle shell, sand and packing, indicated at 32, would fill the clearance between the exterior surface of the liner and the interior surface of the ladle shell, including the floor thereof. The ladle of FIGS. 5 to 7 demonstrates that as there is no outward extension from the liner body such as that below the pouring lip of the FIG. 3 liner, the ladle shell does not need to be correspondingly extended outwardly, as with the prior art, to accommodate such an extension. This is clearly a desirable advantage/improvement and satisfies a long standing problem with such lined ladles.

Accordingly, in the embodiment described, by keeping the liner as cylindrical as possible, it can fit into existing ladles without them needing to be modified. In other words the outer metallic ladle shell can remain of cylindrical or truncated cone shape and does not need to be modified to accommodate the outward extension of the prior art liner arrangement described in relation to FIG. 3.

Accordingly once the ladle shell dimensions are known, an appropriately sized ladle liner can be taken to a foundry, fitted and then tested. This allows a liner supplier to take to the foundry merely the new liner together with packing sand and other ancillary assembly supplies. The lined ladle can then be prepared and a trial undertaken on the same day, with the advantages of the KALTEK (RTM) ladle liners demonstrated.

The cost savings of using a narrower tile more than compensates for the need to extend inwardly the internal surfaces of the KALTEK (RTM) lining, given that the cost of conventional refractory material verses KALTEK (RTM) material is approximately 5:1. Previously it was questioned whether providing enlarged areas by virtue of increasing the thickness of the sidewall, would cause a curing problem with the vacuum formed KALTEK (RTM) lining. However during experimentation and trials it was found that the possibly expected curing problem did not materialise if the thickness increase was not too large. Moreover, unexpectedly, it has been found that there is not that much of an increase in KALTEK (RTM) material required as the forming operation for the liner caused the sections in question to 'suck in' somewhat.

In selecting the width of the tile, and the amount of inward 'thickening' of the interior wall portions mounting the tile two factors however need to be considered. Firstly the tile must not be so close to surface 27 as to cause a 'pinching' effect (reducing metal flow) at the bottom of the tile, and secondly if the inward thickening is too great, the portions will have too thick a section which can cause difficulties in curing during manufacture.

Finally it is considered that the invention may result in lower turbulence of metal flow out of the liner as a consequence of the nature and position of the barrier.

Whilst the material of the body 25 is preferably of KALTEK (RTM), any other suitable refractory liner material could be used. Although shown extending to the level of the open top of the body 25, the tile 31 in another embodiment, could terminate short thereof. The tile could clearly be formed other than by casting.

With the embodiment of FIGS. 5 to 7, the tile 31 can terminate above the inner surface of the floor 26, for example as shown in full lines and sectioning in FIG. 7, in order to allow molten metal to flow, in use, from the hollow interior of the lining into the spout 30 for discharge from the ladle. This arrangement is the most preferable in that the length of the tile, and thus its cost, is minimised. However in an alternative arrangement shown in dashed lines in FIG. 7, the tile used partly to define the spout has a length such that it extends from the open top of the body to the floor thereof. However to allow metal to flow from the interior of the liner to the spout, the lower part of the tile is provided with one or more through openings 33 of any suitable form.

Figure 8:
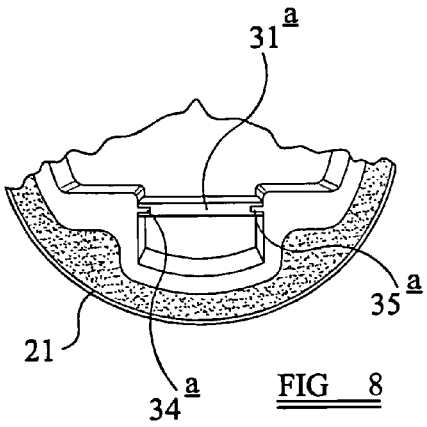
FIG. 8 is a scrap top plan view of part of another embodiment of a ladle of the invention.

FIG. 8 is a scrap view of the ladle of FIGS. 5 to 7, modified solely in the manner by which the tile 31*a* of the liner is fitted in place. Here instead of the opposite longitudinal tile edges (edge surfaces) being received in respective grooves in the inwardly extending portions of the sidewall, respectively, these portions are provided with respective inwardly extending projections 34*a*, 35*a* which fit into respective longitudinal grooves extending within the opposite longitudinal edge surfaces of the tile, refractory cement or equivalent again being provided to secure the tile to the inwardly extended portions at which the opposite longitudinal edge surfaces/edges of the tile are received, or the tile being secured during the liner manufacture. With this arrangement the width of the tile could be further reduced, with the respective projections effectively-forming part of the rear wall, which, with the facing sidewall surface, defines the spout of the lining.

Whilst the ladle shell of FIGS. 5 to 7 is without a pouring lip, this could be provided, and such a metal lip of the ladle shell packed with bonded sand when sand is packed between a non-lipped liner and the ladle shell. In a still further arrangement the liner and the ladle could have respective pouring lips, so that the ladle shell is in the form of a lip pour ladle, and the teapot liner is intended specifically therefor.

As shown with the embodiment of FIGS. 5 to 7, the inwardly extending portions are at respective portions of the sidewall of the liner which are relieved inwardly from the exterior thereof, to reduce the KALTEK (RTM) material required.

Accordingly it will be appreciated that the problems and disadvantages of the prior art referred to are overcome by this invention. If required, the only item specific to the foundry would be the lip design. Any lip design which a foundry prefers can easily be customized for production. An initial trial can be run with a prototype liner by building the lip out of conventional refractory material. If the product proves to be of economic benefit, the specific lip design can then be built into the one-piece liner design and sold as a custom unit.

The invention claimed is:

1. A liner for a ladle, the liner comprising a body of refractory material defining a hollow interior, the body having a continuous sidewall bounding said hollow interior, a lower closure floor and an open top, a barrier of refractory material facing an interior surface of part of the sidewall and being spaced inwardly therefrom in said hollow interior, the barrier extending from at or near the open top of the body towards said lower closure floor to define, with said facing part of said sidewall, a spout for discharging molten metal, in use, from said interior of the ladle, the barrier having two longitudinal edge surfaces, two facing inner portions of the sidewall being extended inwardly, said longitudinal edge surfaces of the barrier being received at said inwardly extended portions respectively, thereby positioning said barrier at said inward spacing from, and facing, said interior surface of part of the sidewall wherein said liner has a cylindrical or truncated cone shape outer surface and said spout does not extend outwardly of said outer surface.

2. A liner as claimed in claim 1, wherein the longitudinal edge surfaces of the barrier are received in respective complementary grooves in said inwardly extended portions respectively.

3. A liner as claimed in claim 1, wherein respective projections of said inwardly extended portions are received in complementary grooves in said longitudinal edge surfaces respectively.

4. A liner as claimed in claim 1, wherein said inwardly extended portions of the sidewall provide respective flat facing surfaces.

5. A liner as claimed in claim 4, in which said flat facing surfaces are parallel.

6. A liner as claimed in claim 4, wherein said barrier is flat, and its longitudinal edge surfaces are received at said facing surfaces respectively, with said flat barrier being disposed normal to said flat facing surfaces.

7. A liner as claimed in claim 1, in which refractory cement is used to fix the barrier in place at said inwardly extended portions.

8. A liner as claimed in claim 1, in which the barrier is secured in place as part of the manufacture of the body of the liner.

9. A liner as claimed in claim 1, wherein the barrier terminates spaced from the lower closure floor of said body.

10. A liner as claimed in claim 1, wherein the barrier extends to the lower closure floor of said body, with there being an aperture therein adjacent its lower end.

11. A liner as claimed in claim 1, wherein the barrier extends from the level of the open top of said body.

12. A liner as claimed in claim 1, wherein the barrier is in the form of a refractory or ceramic tile.

13. A liner as claimed in claim 12, wherein the tile is of castable material.

14. A liner as claimed in claim 1, wherein the barrier is flat.

15. A ladle comprising an outer metal shell defining a hollow interior, the shell having a continuous inner sidewall, bounding said interior of the shell, a lower closure floor and an open top, and the ladle also comprising a liner, retained in said interior of the shell, in use, the liner comprising a body of refractory material defining a hollow interior, the body having a continuous sidewall bounding said hollow interior, a lower closure floor and an open top, a barrier of refractory material facing an interior surface of part of the sidewall of the body and being spaced inwardly therefrom in said hollow interior of the liner, the barrier extending from at or near the open top of the body towards said lower closure floor of the liner to define, with said facing part of said inner sidewall of the liner, a spout for discharging molten metal, in use, from said interior of the liner, the barrier having two longitudinal edge surfaces, two facing portions of the inner sidewall of the liner being extended inwardly, said longitudinal edge surfaces of the barrier being received at said inwardly extended portions respectively, thereby positioning said barrier at said inward spacing from and facing, said interior surface of part of the sidewall, wherein said liner has a cylindrical or truncated cone shape outer surface and said spout does not extend outwardly of said outer surface.

16. A ladle as claimed in claim 15, in which the shell has a lip extending outwardly thereof at said open top, for pouring molten metal from the ladle.

* * * * *